United States Patent [19]

Lurbiecki

[11] 4,063,866

[45] Dec. 20, 1977

[54] CONCRETE BLOCK FORMING AND FACING MACHINE

[76] Inventor: Manfred A. Lurbiecki, 2708 Panorama Drive, North Vancouver, B.C., Canada, V7G 1V6

[21] Appl. No.: 682,592

[22] Filed: May 3, 1976

[51] Int. Cl.[2] ..... B28B 23/00

[52] U.S. Cl. ..... 425/517; 425/424; 425/431; 425/443

[58] Field of Search ..... 425/125, 126, 130, 517, 425/421, 422, 424, 442, 443, 431; 264/271, DIG. 51

[56] References Cited

U.S. PATENT DOCUMENTS

| | | | |
|---|---|---|---|
| 3,277,551 | 10/1966 | Sekiguchi | 425/422 |
| 3,426,112 | 2/1969 | Taylor-Smith | 425/424 |
| 3,590,447 | 7/1971 | Taylor-Smith | 425/130 |
| 3,799,717 | 3/1974 | Nedoh | 425/126 R |

*Primary Examiner*—Francis S. Husar
*Assistant Examiner*—John McQuade
*Attorney, Agent, or Firm*—Fetherstonhaugh & Company

[57] ABSTRACT

A machine for manufacturing concrete building blocks faced with a decorative material is provided with a mold having a wall which is removable to expose a face of a freshly cast block. The material is arranged on a horizontal panel alongside the block and this panel is pivoted into a vertical position to apply the material to the exposed face of the upright block. A clamping and vibrating action is applied to the panel to further embed the material in the vertical face.

6 Claims, 5 Drawing Figures

CONCRETE BLOCK FORMING AND FACING MACHINE

Figure 1:
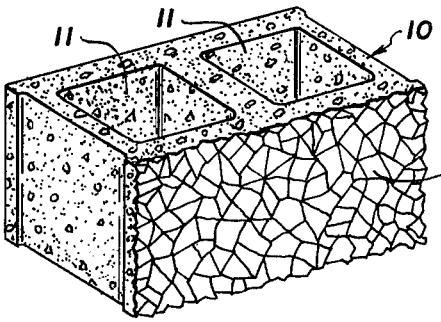

This invention relates to means for manufacturing concrete building blocks and simultaneously providing at least one face of the block with a decorative coating.

A hollow building block when formed in a mold using concrete as the casting material must be cast in an upright position. The term "upright" as used herein will refer to the normal position of use of the block, for example, as such blocks would appear in a wall or other structure bonded together with mortor. Since a newly cast concrete block does not have the structural strength to support itself on its side, or on end for that matter, as it hardens, the upright position is mandatory.

This has lead to complications when the block is to be finished on one or more sides with stone or other particles. When conventional manufacturing machines and methods are used, the block is cast upright in the normal way and is then laid on its side to receive the facing material which is placed on a supporting tray so that it can be pushed upwardly from below. The concrete used for casting is a fairly dry, or so-called "no slump" mix which is designed to retain the shape of the block only as long as the block is upright. However, once the block is turned onto its side to receive the stone facing, crumbling and distortion takes place since the hollows in the block weaken the structure in some critical regions and the block is further misshapen when pressure is applied to embed the facing. The faced block must then be returned to its upright position and an attempt made to reshape and recompress the block to its original condition. This has resulted in a manufacturing process which is unacceptedly slow and costly with a great number of the block being rejected through failure to meet the required standards.

In the present invention, the above as well as other manufacturing problems are overcome by providing a means of facing the cast block in an upright position. Blocks can then be produced quickly and easily as well as economically without the distorting and weakening effects usually encountered when conventional apparatus is used and procedures followed. The finished block, has been found to meet required standards and the unit cost is kept to a desirable minimum when this invention is practiced.

More specifically, a device in accordance with the present invention may be said to comprise a concrete building block and facing machine including a mold for casting said blocks in an upright position, said mold having a movable wall initially covering a vertical face of the block, means for removing the removable wall to expose the vertical face to the then uncured block supported by the remainder of the mold, an applicator panel for supporting a horizontal layer of facing material, and means for moving the applicator panel to apply the facing material to the vertical face.

Further disclosed is a method of forming a concrete block which comprises the steps of casting the block upright in a mold, arranging facing material in a horizontal layer alongside the mold, removing part of the mold to expose a vertical face of the uncured block, swinging the horizontal layer upright to apply the facing material to the vertical face, and pressing and vibrating the facing material to partially embed it in the vertical face.

Figure 2:
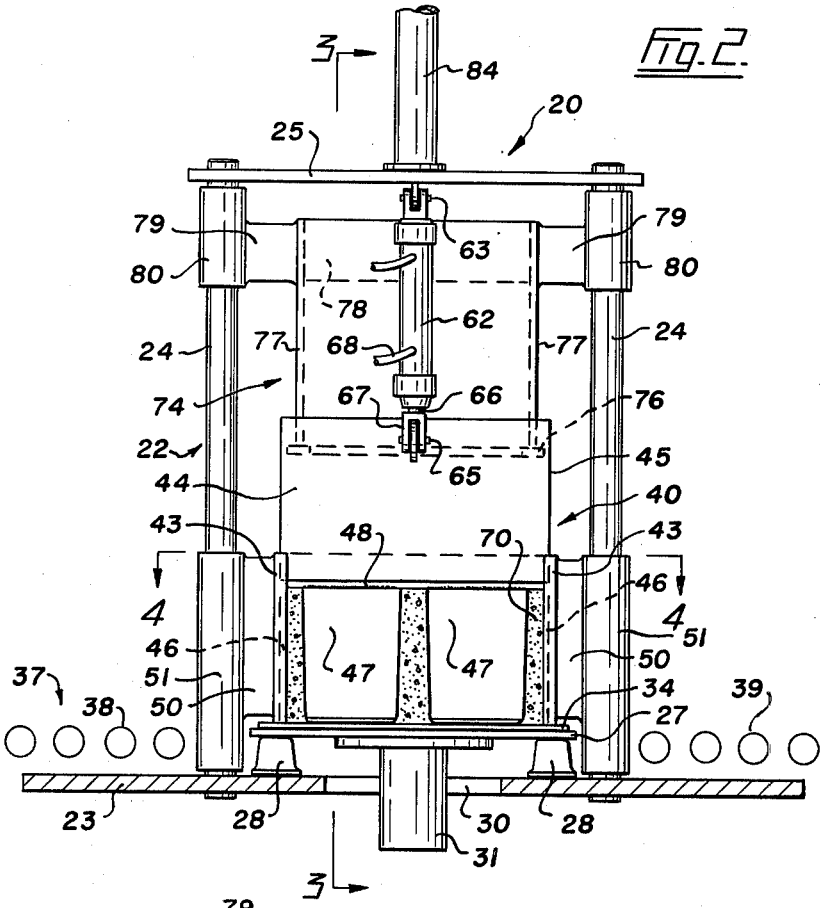
Figure 5:
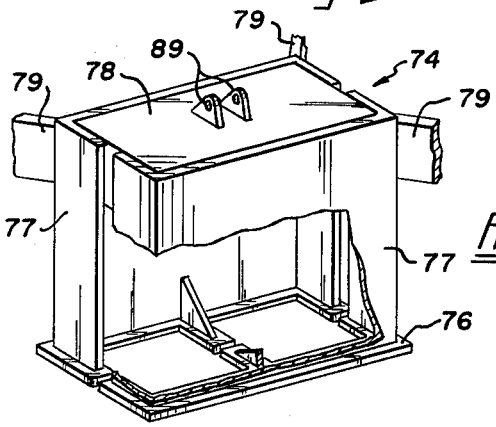
Figure 3:
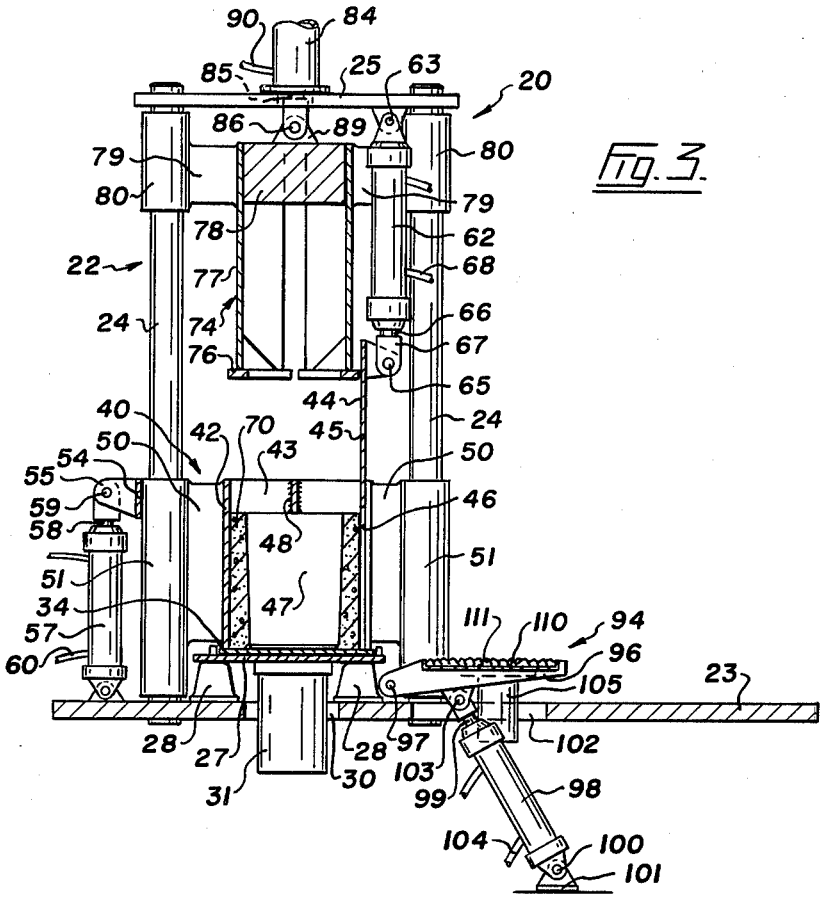
Figure 4:
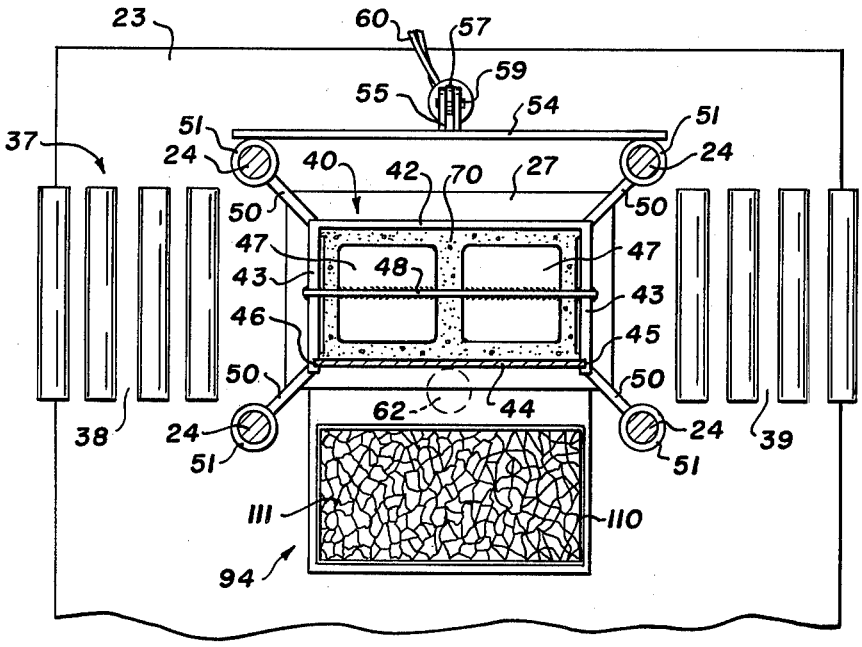

In drawings which illustrate a preferred embodiment of the invention,

FIG. 1 is a perspective view of a hollow, concrete building block faced with decorative stone as produced by the present invention, FIG. 2 is a front elevation of a building block forming and facing machine, FIG. 3 is a vertical section taken on the line 3—3 of FIG. 2, FIG. 4 is a horizontal section taken on the line 4—4 of FIG. 2, and FIG. 5 is a perspective view, with parts broken away, of a tamping die of the machine, the view appearing on the first sheet of drawings.

Referring first to FIG. 1, the numeral 10 designates a type of building block formed of concrete. This oblong block is hollow, that is, it has side-by-side openings 11 extending through from top to bottom of the block. Such concrete blocks are widely used to build walls as well as other structures and, when the front faces of the block are exposed to view, it is sometimes desirable to cover them with a decorative facing 12. This facing 12 very often is stone chips which are colorful and attractive in contrast to the drab, grey concrete.

Referring now to remaining views of the drawing, the numeral 20 indicates generally a machine for forming and facing the blocks 10. The machine 20 comprises a frame 22 which may be mounted on a table 23 or other suitable support. Frame 22 has four corners posts 24, the posts being secured at their lower ends to the table 23 and being connected together at the upper ends by a rectangular top plate 25.

The machine 20 is provided with a platform 27 which is supported above the table 23 upon rubber blocks 28. An opening 30 is provided in the table 23 and a vibrator 31, secured to the underside of this platform, projects downwardly through this opening. The vibrator 31, which may be electrically powered, is of conventional design.

The platform 27 is adapted to support a pallet 34 on which a concrete block is cast and subsequently is removed from the machine. Such rectangular pallets 34 are adapted to be fed one at a time to the machine by means of a conveyor 37 (shown diagrammatically in FIG. 2 only) having an infeed portion 38 on one side of the opening 30, and an outfeed portion 39 on the opposite side of said opening.

A pallet 34 is supported by the platform 27 beneath a mold generally indicated at 40. Mold 40 has a rear wall 42 which is joined to parallel end walls 43. A front wall 44 extends between the end walls 43 the mold 40 spaced from and parallel to the rear wall 42. In FIG. 4, end edges 45 of the front wall 44 are shown slidably mounted in grooves 46 formed in opposite faces of the end walls 43. The mold 40 includes a pair of cores 47 which serve to form the openings 11 in the concrete block. These cores are connected together at their upper ends by a bar 48 as shown in FIGS. 3 and 4. The opposite ends of the bar 48 are welded or otherwise secured to the end walls 43 of the mold.

The rear and two end walls of the mold 40, as well as the cores 47, are adapted to be moved as a unit vertically within the frame 22 and therefore those walls are connected by webs 50 to sleeve bearings 51 which are slidably mounted one on each of the corner posts 24 of the frame. The two sleeve bearings 51 at the rear of the frame are connected by a horizontal bar 54 and a pair of centrally disposed brackets 55 project rearwardly of this bar. Mounted on the table 23 is a hydraulic cylinder 57 having a piston rod 58 which is connected to the brackets 55 by means of a pin 59. Cylinder 57 is connected by hose lines 60 into a hydraulic circuit (not otherwise shown) which allows the mold walls 42 and 43 to be raised and lowered as a unit within the frame under control of the operator of the machine.

Front wall 44 is adapted to be moved up and down independently of the other three walls of the mold. As shown best in FIG. 2, a hydraulic cylinder 62 is secured as at 63 to the top plate 25 of the frame and a pin 65 attaches a piston rod 66 of this cylinder to a bracket 67 projecting forwardly of the upper edge of the front wall 44. Cylinder 62 is connected by hose lines 68 into the previously mentioned hydraulic circuit allowing the operator of the machine to raise and lower the front wall 44.

The several mold parts define a cavity 70 closed at the bottom by the pallet 34 and which is filled with concrete to form a block 10 and that concrete is pressed down by means of a tamping arrangement generally indicated at 74. The tamping means 74 comprises a die 76 which is shaped as shown best in FIG. 5 to straddle the upper ends of the cores 47 and the core bar 48. The die is carried at the lower ends of four vertical support walls 77 which depend from a head block 78. The head block 78 is suitably connected by webs 79 to sleeve bearings 80 (FIGS. 2 and 3) which are slidably mounted on the posts 24.

The tamping means 74 is moved up and down in the frame by a hydraulic cylinder 84 mounted on the top plate 25 of the frame. A piston rod 85 of this cylinder is connected by a pin 86 to brackets 89 on the top of the head block 78. Hose lines such as the one indicated at 90 in FIG. 3 connect opposite ends of the cylinder 84 into the hydraulic circuit.

The machine 20 is provided with means for applying the decorative stone facing 12 to at least one face of a block 10 cast in the mold 40 and this means is generally indicated at 94. As shown best in FIG. 3, the applicating means 94 comprises a rectangular panel 96 which is pivotally mounted as at 97 on the table 23 near the front wall 44 of the mold. The applicator panel 96 normally is supported in a horizontal position by a cylinder 98 and piston rod 99 arrangement as shown in FIG. 3. The cylinder 98 is connected as at 100 to a suitable support 101 located below the table 23. Rod 99 projects upwardly through an opening 102 formed in the table and a pin 103 connects said rod to the panel 96. Hose lines 104 extend from opposite ends of the cylinder 98 and these lines also form part of the previously mentioned hydraulic circuit. Another vibrator 105 is secured to the underside (as shown in FIG. 3) of the panel 96. This vibrator 105 may also be electrically powered and therefore is connected with the vibrator 31 into a suitable circuit (not shown) which allows the operator of the machine 20 to energize either vibrating device when necessary.

The applicator panel 96 is adapted to support a rectangular tray 110 which contains a layer 111 of stone chips intended to provide the facing 12 for the concrete block. An appropriate number of these trays 110 are preloaded with a measured amount of this facing material, the the chips being leveled out and suitably arranged so that the loaded trays can be fed one at a time into the machine 20.

The machine 20 is operated to make blocks and face them with decorative stone as will now be described. First, a pallet 34 is moved along the conveyor 37 and is centered within the frame. The several walls of the mold 40 are positioned over the pallet to define the cavity 70. A stone-loaded tray 110 is transferred to the then horizontally disposed panel 96. Cavity 70 is filled with wet concrete using conventional filling equipment which is not shown. The die 74 is lowered and the vibrator 31 is operated to compact the concrete in the cavity. Wall 44 is raised and panel 96 is swung upwardly to partially embed the facing material in the block. Pressure is applied to the stone by the cylinder 98 and the vibrator 105 is energized to firmly secure the stone to the concrete. The applicator panel 96 is then lowered and the steps required to remove the uncured block from the machine can then be taken.

The foregoing procedure produces a finished and faced building block which is ready for use after being removed from the machine and cured. In order that the block may be removed from the machine 20, the rear and end walls 42 and 43 plus the cores 47 are raised as a unit by pressurizing the lower end of cylinder 57 so that the cores are withdrawn from the block and the three connected walls are at the same level as the front wall 44. This leaves the recently cast and still upright block resting on the pallet 34 which in turn is supported by the platform 27. The pallet is moved along the outfeed portion 39 of the conveyor whereupon the curing process can begin.

It will be noticed that the block remains upright at all times and therefore is not weakened or distorted in any way during the manufacturing process. The amount of stone material loaded into each tray 110 is measured and, of course, is evenly spread so that each block recieves the same facing. As the applicator panel 96 is swung upwardly the force of acceleration serves to hold the rock within the tray so that none is spilled. The impact of the facing material against the then soft concrete, and the subsequent vibrating and clamping action, holds the material in place and ensures that the stone chips are properly bonded by the concrete to the face of the block. The machine can be operated by one man assisted by someone preparing the trays and another transfering the completed blocks from the machine to the curing ovens or elsewhere. The method lends itself to a particularly efficient and economical system for producing faced blocks.

The machine has been described as intended for use in providing only one face of a concrete block with a decorative stone facing by obviously other faces of the block may be similarly faced if obvious modifications are made to the machine. For example, the rear wall 42 of the mold can be made vertically and independently movable and another applicating means 94 would then be provided to apply a stone facing to the opposite side face of the block. One end of a block used on a corner of a wall may require a facing of stone and this can be done using a similar method and means.

I claim:

1. A machine for forming and facing a concrete block having a vertical face comprising a mold for casting said block in an upright position, a pallet beneath the mold, said mold having a movable wall adapted to initially cover the vertical face of the block, means operatively associated with said movable wall for removing the movable wall from the then uncured block which is adapted to be supported by the remainder of the mold and pallet, an applicator panel mounted alongside the mold adapted to support a horizontal layer of facing material, and means operatively associated with said applicator panel for moving the applicator panel to apply the facing material to the vertical face of the block.

2. A machine as claimed in claim 1, and including vibrating means associated with the applicator panel operable to vibrate the facing material as it is applied to the vertical face of the block.

3. A machine for forming and facing a concrete block having a vertical face; comprising a frame, a mold supported by the frame for casting the block in an upright position, said mold including a vertically movable wall adapted to initially cover the vertical face of the block, means carried by the frame for moving the wall vertically to expose the vertical face of the then uncured block supported by the remainder of the mold, an applicator panel pivotally supported by the frame alongside the mold adapted to receive a horizontal layer of facing material, means operatively associated with said applicator panel for swinging the applicator panel towards and away from the mold whereby to apply the facing material to the vertical face of the block, and a vibrating device operatively associated with said applicator panel for vibrating the applicator panel as the facing material is applied to the vertical face of the block.

4. A machine as claimed in claim 3, in which said mold has other walls cooperating with the vertically movable wall to enclose the block, said other walls being slidably mounted on the frame, and means carried by the frame for raising and lowering said other walls independently of the vertically movable wall.

5. A machine as claimed in claim 4, and including a pallet associated with the mold, a platform resiliently mounted in the frame for supporting the pallet beneath the mold, and means operatively associated with said platform for vibrating the platform to impart vibratory motion to the pallet and the mold.

6. A machine as claimed in claim 5, and including concrete- tamping means slidably mounted on the frame, and means operatively connecting the concrete-tamping means to the frame for moving said concrete-tamping means into and out of the mold.

* * * * *